US007446761B2

(12) United States Patent
Tseng

(10) Patent No.: US 7,446,761 B2
(45) Date of Patent: Nov. 4, 2008

(54) METHOD OF READING AND MODIFYING IDENTIFICATION DATA OF A DISPLAY

(75) Inventor: Shih Hua Tseng, Taipei (TW)
(73) Assignee: Tatung Co., Ltd., Taipei (TW)

( * ) Notice: Subject to any disclaimer, the term of this patent is extended or adjusted under 35 U.S.C. 154(b) by 865 days.
(21) Appl. No.: 10/857,895
(22) Filed: Jun. 2, 2004
(65) Prior Publication Data
US 2005/0030300 A1 Feb. 10, 2005
(30) Foreign Application Priority Data
Aug. 7, 2003 (TW) ..... 92121680 A
(51) Int. Cl.
*G09G 5/00* (2006.01)
(52) U.S. Cl. ..... 345/204; 345/3.1; 345/698; 345/699; 715/716; 715/746; 700/83
(58) Field of Classification Search ..... 345/3.1–3.4, 345/204, 698, 699; 700/83; 715/526, 716, 715/746
See application file for complete search history.

(56) References Cited

U.S. PATENT DOCUMENTS 6,373,476 B1 * 4/2002 Dalgleish et al. ..... 345/204
6,697,033 B1 * 2/2004 Leung et al. ..... 345/5
6,859,200 B2 * 2/2005 Park et al. ..... 345/204
6,907,482 B2 * 6/2005 Maciesowicz ..... 710/63
7,138,989 B2 * 11/2006 Mendelson et al. ..... 345/204

* cited by examiner

*Primary Examiner*—Henry N Tran
(74) *Attorney, Agent, or Firm*—Bacon & Thomas, PLLC

(57) ABSTRACT

The present invention discloses a method of reading and modifying identification data of a display, the method reads and modifies an identification data of a display to obtain a related identification data, the user interface displays the identification data or related identification data in a manner that the user can understand, and allows the user to modify the identification data and stores the modified identification data into the display.

5 Claims, 6 Drawing Sheets

Inf Content

```
;==========================================================
;This is a setupfile for TATUNG Monitors
;The monitor INF file for Windows 95/98/Me/2000
;L7HMT.inf, Jul 01, 2003
;==========================================================
;
;----------------------------------------------------------
[Version]
CatalogFile=TATUNG.cat
signature="$CHICAGO$"
Class=Monitor
ClassGuid={4D36E96E-E325-11CE-BFC1-08002BE10318}
Provider=%TATUNG%
DriverVer=07/01/2003,2.0.4.3

;Monitor class install (required for NT)
[ClassInstall32]
AddReg=ClassAddReg32

[ClassAddReg32]
HKR,,,,%MonitorClassName%
HKR,,Icon,,"-1"
HKR,,NoInstallClass,,1

[DestinationDirs]
DefaultDestDir = 11
TATUNG_L7HMT.CopyFiles = 23
```

Print Save OK

FIG. 7

Translate Edid Data

```
                ************************************************
                *              TATUNG CORPORATION              *
                *              Date: Tue Jul  1, 2003          *
                *          EDID Version# 1, Revision# 3        *
                *                DDC/EDID Test for             *
                *                      L7HMT                   *
                ************************************************


*128  BYTES OF EDID CODE:
*DDC  0  1  2  3  4  5  6  7  8  9  A  B  C  D  E  F
0000 00 FF FF FF FF FF FF 00 50 34 B0 1D 02 00 00 00
0010 13 0C 01 03 6F 22 1B 78 2A 87 06 A5 5C 47 9C 25
0020 1E 4F 54 BF EF 80 81 80 31 CA 01 01 01 01 01 01
0030 01 01 01 01 01 01 30 2A 00 98 51 00 2A 40 30 70
0040 13 00 52 0E 11 00 00 1E 00 00 00 FF 00 54 54 32
0050 31 39 30 30 30 30 32 0A 20 20 00 00 00 FC 00 54
0060 41 54 55 4E 47 20 4C 37 48 4D 54 0A FD 00 38 4C
0070 1F 50 0B 00 0A 20 20 20 20 20 20 00 00 00 00 1D


* EDID EXPLAIN:
*---- Header ------------------------------------------------------------
*(00-07H) : [00 FF FF FF FF FF FF 00]
*---- Vendor/Product Identification -------------------------------------
*(08-09H) : [50 34]          ID Manufacturer Name............... = TAT
*(0A-0BH) : [B0 1D]          ID Product Code.................... = 1DB0
*(0C-0FH) : [02 00 00 00]    ID Serial Number................... = 2 (D)
```

Print Save OK

FIG. 8

METHOD OF READING AND MODIFYING IDENTIFICATION DATA OF A DISPLAY

BACKGROUND OF THE INVENTION

1. Field of the Invention

The present invention relates to a method of reading and modifying identification data of a display.

2. Description of the Prior Art

As shown in FIG. 1, a display 10 is connected to a computer device 30 via a video card 20 to display data. The display 10 displays data output from the computer device 30. In addition, the display 10 comprises a memory 12 for storing an identification data of the display 10. The identification data include: manufacturer's name, product number, maximum horizontal resolution, maximum vertical resolution and so on. The total data size of the identification data is typically 128 bytes, but may also be 256 bytes.

When the computer device 30 is turned on, an operating system of the computer device 30 reads the identification data of the display 10 and compares them to predetermined identification data. If the identification data of the display 10 match the predetermined identification data, the operating system will output display data to the video card 20 according to the identification data, and the video card 20 outputs the display data to the display 10 according to a predetermined driving manner. When a user wants to change to a new display 10', as the computer device 30 doesn't have the identification data for the new display 10', the operating system requests the user to load a new display driver for the new display 10' to obtain a new identification data of the new display 10'. Subsequently, the operating system outputs the display data to the video card 20 according to the new display driver, and the video card 20 outputs the display data to the display 10.

However, the identification data of the common display 10 is preset by the manufacturer, and is composed of a group of numbers (or codes that are difficult for the ordinary user to understand). As shown in FIG. 2 and FIG. 3, under a different operating system (such as a Windows operating system), it is not just difficult to find the storing location of the identification data, it is also hard for the user to read the contents and modify these settings. Moreover, certain users, such as monitor testing personnel, researchers or maintenance personnel, are unable to test the monitor by modifing the identification data, and there is also no proper changing manner for the identification data.

Therefore, it is desirable to provide a method of reading and modifying identification data of a display to mitigate and/or obviate the aforementioned problems.

SUMMARY OF THE INVENTION

The objective of the present invention is to provide a method of reading and modifying identification data of a display which can decode the identification data so that a user can understand the identification data and modify them.

Another objective of the present invention is to provide a method of reading and modifying identification data of a display that can cause loading of a new display driver of an operating system according to the modified identification data.

Another objective of the present invention is to provide a method of reading and modifying identification data of a display that provides analysis of the identification data and outputs the contents and description as a text file that is readable to a user.

In order to achieve the above mentioned objectives, the present invention provides a method of reading and modifying identification data of a display which comprises (A) reading an identification data from the display; (B) generating a related identification data by making correlation between a plurality of data of the identification data; (C) outputting the related identification data and a corresponding description of the related identification data to a user interface; (D) determining if the related identification data is modified, if the related identification data is modified, then the related identification data would be saved as a modified identification data; and (E) determining if a display driver is generated, if the display driver is generated, then the display driver would be generated according to the modified identification data/the related identification data/the identification data; wherein the display driver would be used to drive the display correctly.

The user interface not only displays the display arguments in a manner that the user can understand, but also allows the user to modify the display arguments and stores the modified arguments into the memory. Furthermore, the user interface can generate a new display driver for an operating system to load according to modified identification data.

Other objects, advantages, and novel features of the invention will become more apparent from the following detailed description when taken in conjunction with the accompanying drawings.

BRIEF DESCRIPTION OF THE DRAWINGS

FIG. 7 is a schematic drawing of a new display driver; and

FIG. 8 is a schematic drawing of a description file of identification data.

DETAILED DESCRIPTION OF THE PREFERRED EMBODIMENT

Figure 1:
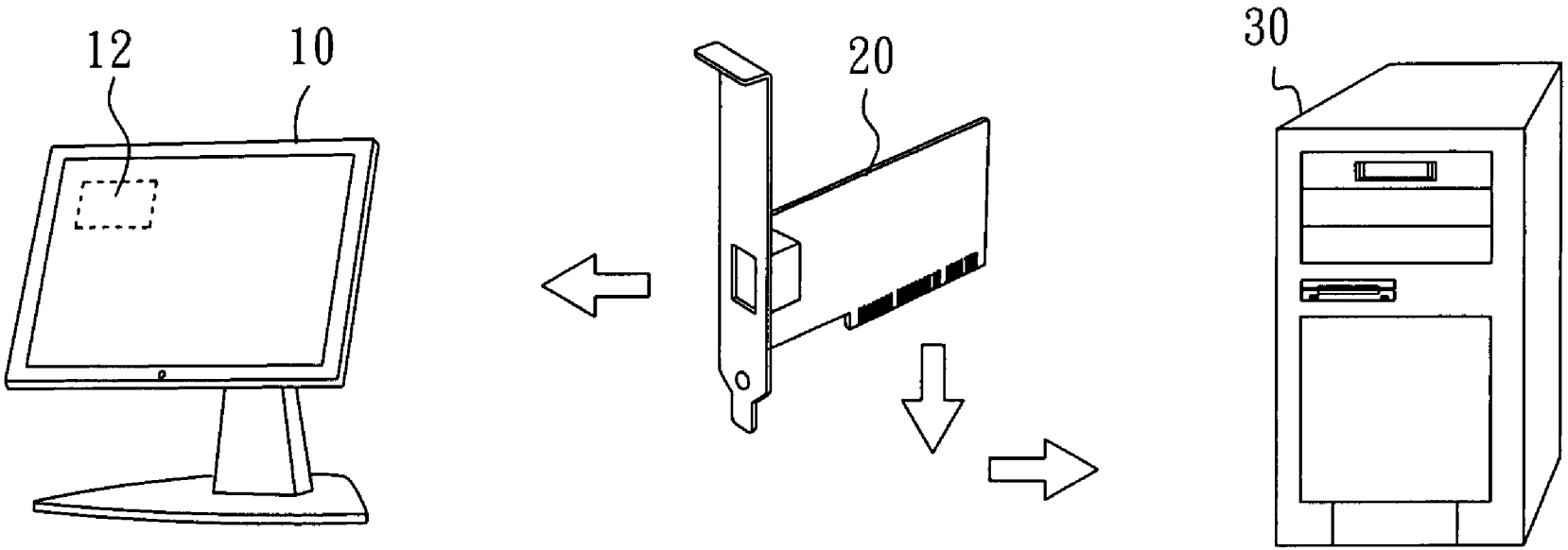
FIG. 1 shows a display, a video card and a computer device.
Figure 2:
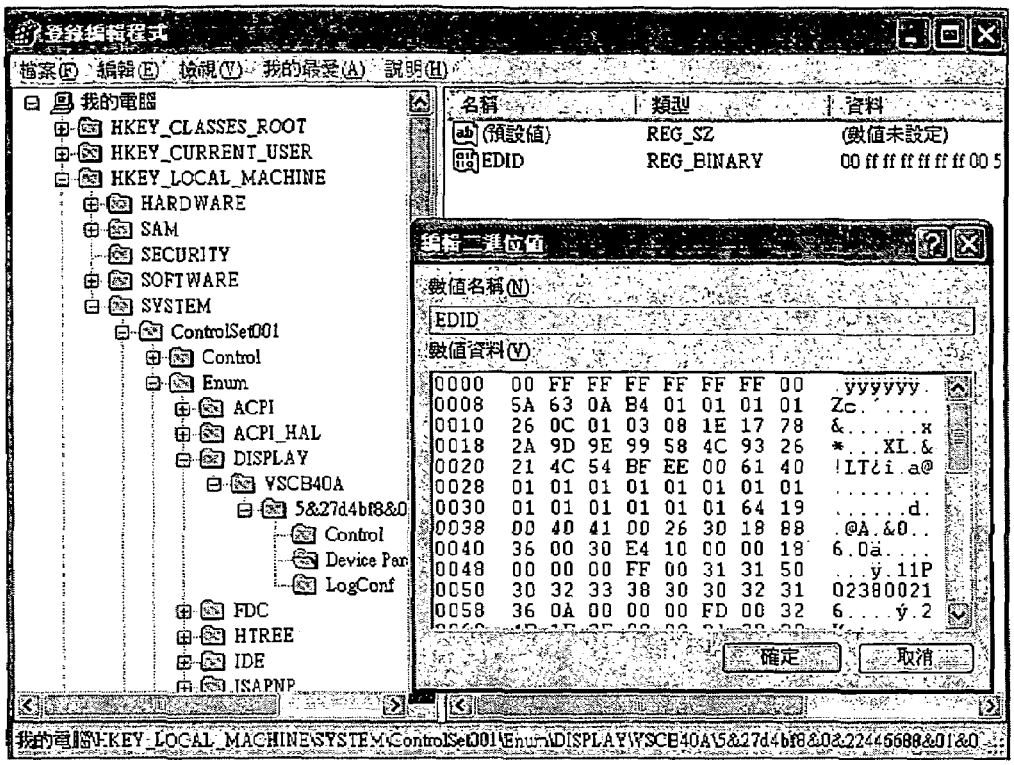
FIG. 2 shows the configuration argument for Windows 2000 and XP operating systems.
Figure 3:
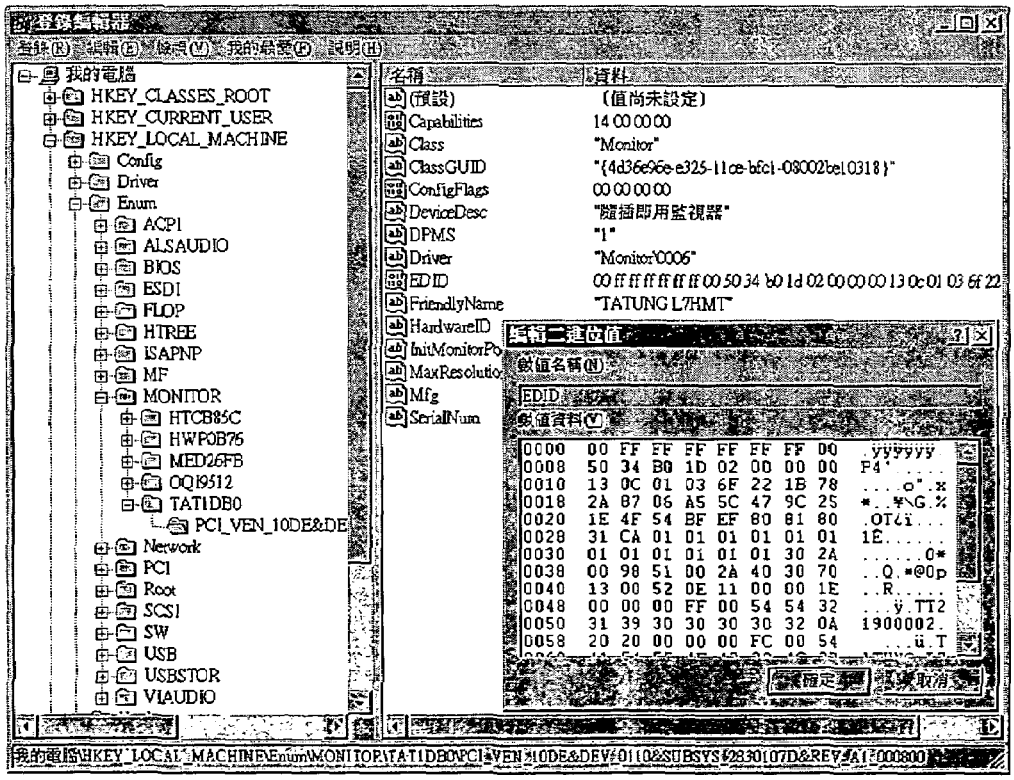
FIG. 3 shows the identification data for Windows 95, 98 and Me operating systems.
Figure 4:
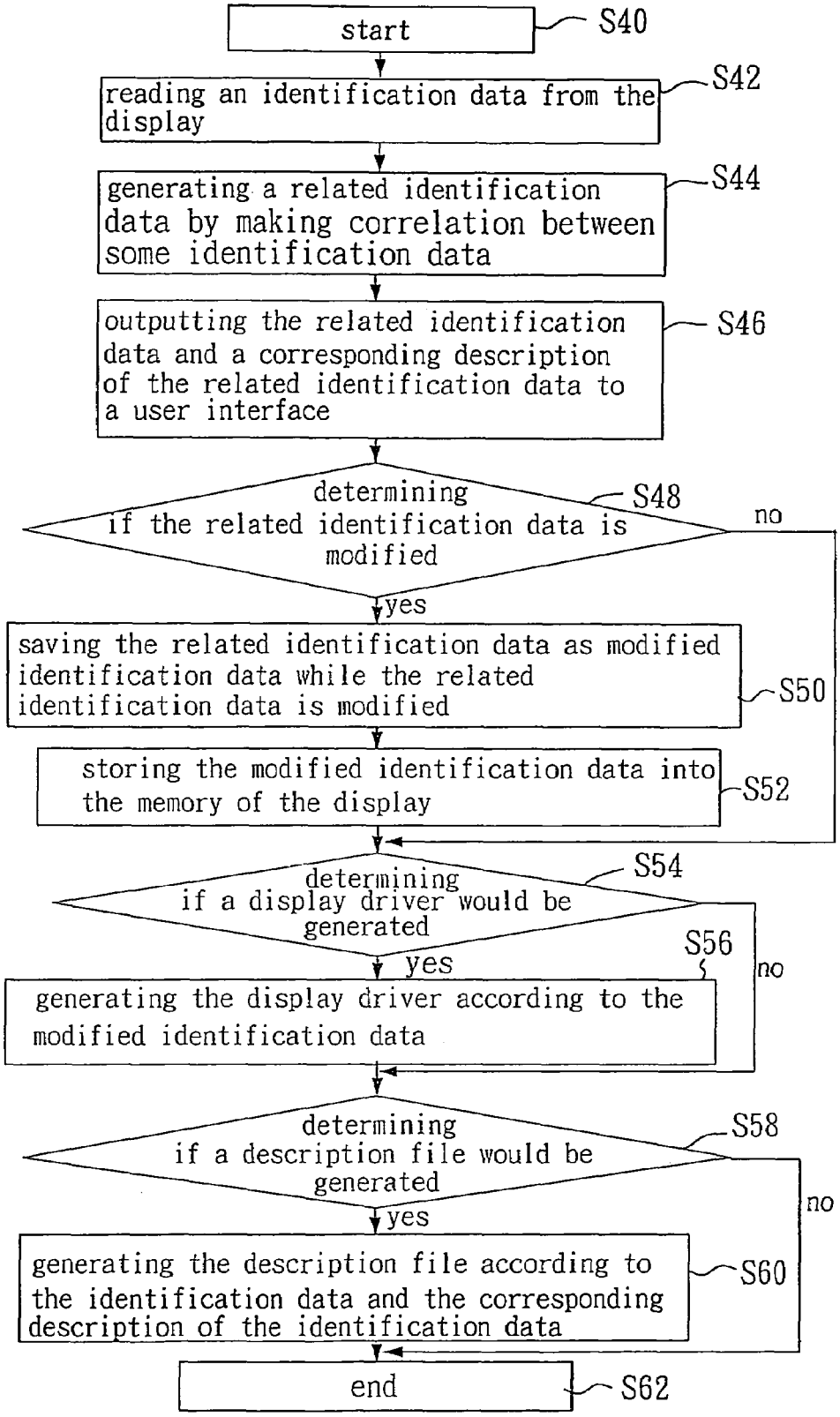
FIG. 4 is a flowchart of the present invention.

Please refer to FIG. 4. FIG. 4 is a flowchart of the present invention. The method of the present invention uses a software program to read the identification data stored in the memory 12 of the display 10 and shows the identification data on a user interface. This enables the user to modify and restore the identification data, and cause loading of a new display driver to update the identification data. The method comprises the following steps:

Step 40: executing the software program.

Step 42: reading an identification data from the display 10. Since a display manner of the display 10 is determined by the stored identification data, the operating system reads and modifies the identification data stored in the memory 12 of the display 10, then restores the modified identification data back to the memory 12 to change the display manner of the display 10. The identification data can be 128 bytes or 256 bytes in size.

Step 44: generating a related identification data by making correlation between some identification data. The formation of the identification data is based on a predetermined standard, such as the Extended Display Identification Data standard (EDID). However, the identification data is composed of a lot of numbers, which are difficult for the user to read directly. Some data of the identification data may be related to each other, so some data of the related identification data are construed together as a group. Consequently, the identification data is decoded to obtain the related identification data that can be understand by the user, and which is then displayed on the user interface. Additionally, a predetermined color can be assigned to each group, so that each group can be easily distinguished.

Figure 5:
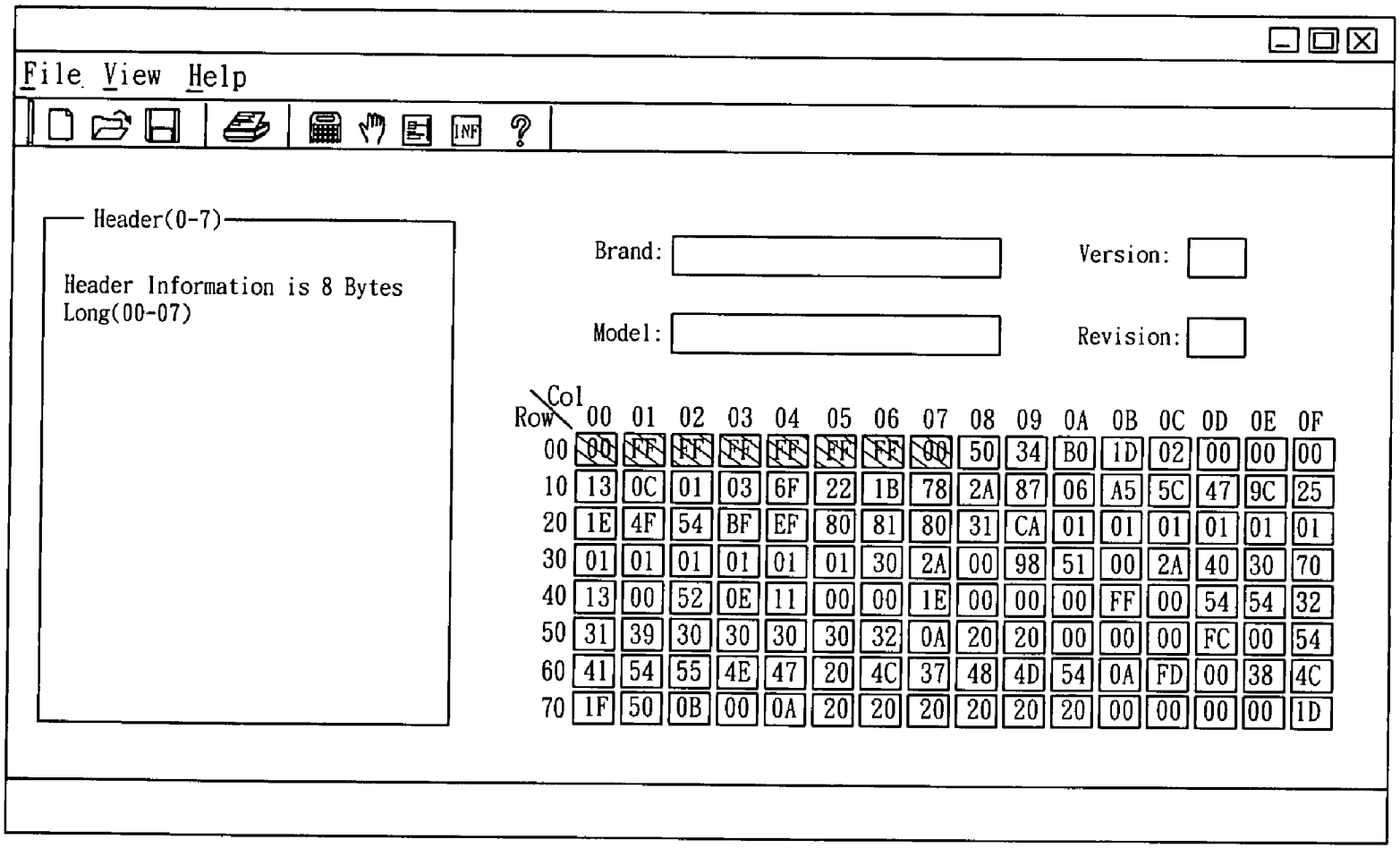
FIG. 5 is a schematic drawing of a user interface.
Figure 6:
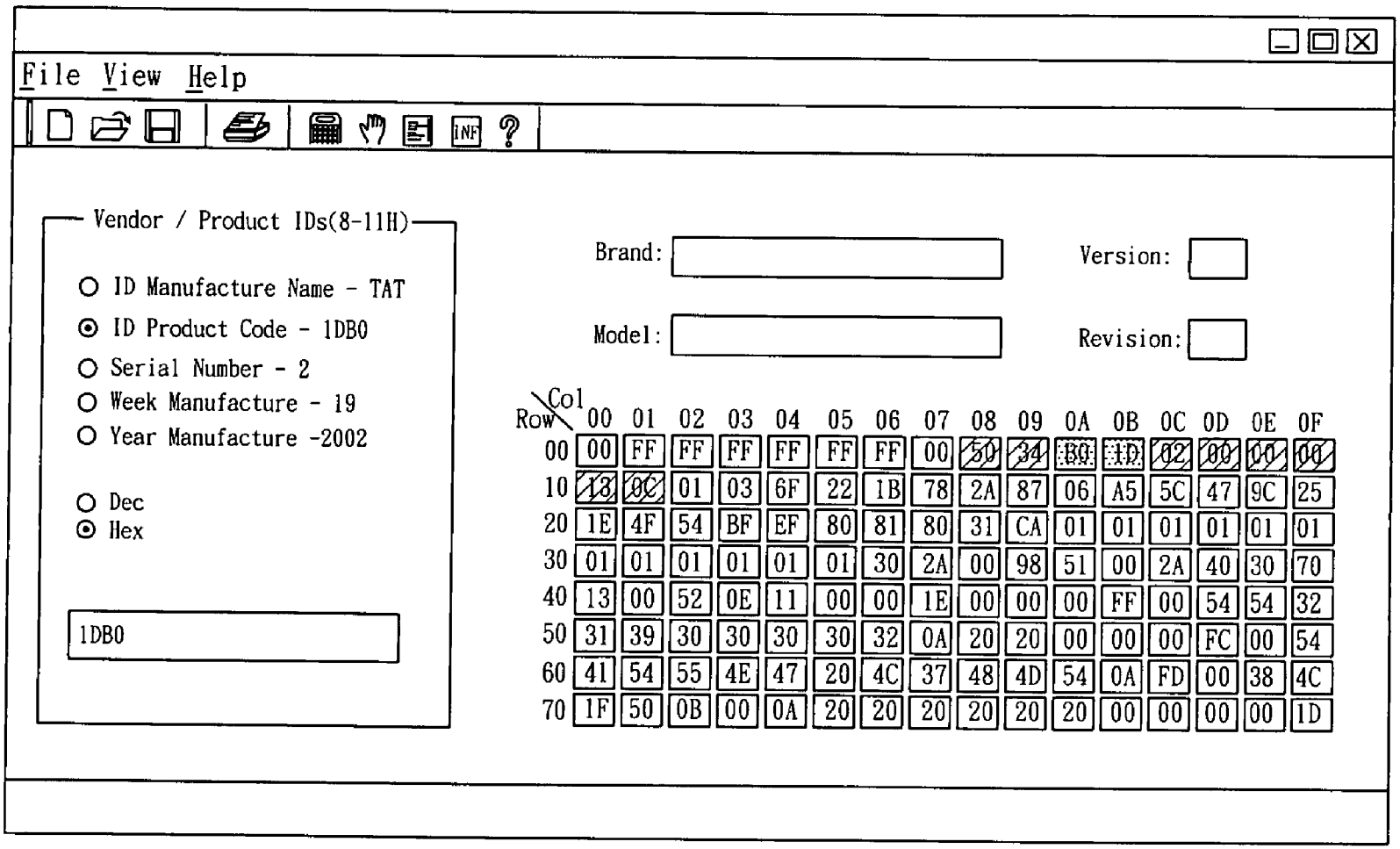
FIG. 6 is a schematic drawing of another user interface.

Step 46: outputting the related identification data and a corresponding description of the related identification data to a user interface. As shown in FIG. 5 and FIG. 6, the user interface shows the related identification data and the corresponding description of the related identification data. For example, the $00^{th}$ to the $07^{th}$ bytes of the related identification data are in a fixed format; the corresponding description reads heading (no meaning) and is presented as black letters on a green background (or reverse oblique line). The $08^{th}$ to $11^{th}$ bytes of the related identification data are decoded as a manufacturer's name (the $08^{th}$ and the $09^{th}$ bytes), a monitor manufacturer's serial number (the $0A^{th}$ and $0B^{th}$ bytes), a sequence code (the $0C^{th}$ to $0F^{th}$ bytes), a manufacture period (the $10^{th}$ byte) and a manufacture year (the $11^{th}$ byte), and are presented as black letters on a blue background (or oblique line). Each byte can be treated individually; when the user wants to change an identification datum, such as changing the monitor manufacturer's serial number, the user interface presents the modified identification datum as a black letter on a green background (or dotted), so the user can clearly determine a range of the modified identification datum. The above-mentioned bytes are presented in hexadecimal notation; however, as is well known, they may also be presented in decimal notation.

Step 48: determining if the related identification data is modified; if yes, then step 50 is performed; if no, then step 54 is performed.

Step 50: saving the related identification data as modified identification data while the related identification data is modified.

Step 52: storing the modified identification data into the memory 12 of the display 10.

Step 54: determining if a display driver would be generated; if yes, step 56 is performed; if no, step 58 is performed.

Step 56: generating the display driver according to the modified identification data. Since the memory 12 stores the modified identification data, which is different from the previous identification data, the operating system cannot drive the display 10 correctly. The user interface can generate a new display driver according to the modified identification data, and the new display driver can be loaded in the operating system. After the operating system loads with the modified identification data, the computer device 30 can drive the display 10 correctly. As shown in FIG. 7, the content of the new display driver is generated by the operating system such as windows 95/98/Me/2000.

Step 58: determining if a description file would be generated; if yes, then step 60 is performed; if no, then step 62 is performed.

Step 60: generating the description file according to the identification data and the corresponding description of the identification data. Because the formations of the identification data, the related identification data and the modified identification data are the same, the description file can be generated according to one of them. As shown in FIG. 8, the user interface outputs the modified identification data and the corresponding description of the modified identification data as the description file for the user to read.

Step 62: end the software program.

When the computer device 30 is turned on, the user can use the software program of the present invention to read the identification data of the display 10, modify the identification data through the user interface, store the modified identification data into the memory 12, generate a new display driver and output the description file. When the computer device 30 is reset, if the identification data of the display 10 and the identification data stored in the computer device 30 are different, the operating system requests to load a new display driver. When the user provides the new display driver to the operating system, the operating system can drive the display 10 according to the new display driver. Therefore, the identification data of the display 10 can be modified and the new display driver can be generated. The computer device 30 can be a personal computer, a server or a portable computer.

Although the present invention has been explained in relation to its preferred embodiment, it is to be understood that many other possible modifications and variations can be made without departing from the spirit and scope of the invention as hereinafter claimed.

What is claimed is:

1. A method of reading and modifying identification data of a display comprising:

(A) reading an identification data from the display;

(B) generating a related identification data by making correlation between a plurality of data of the identification data;

(C) outputting the related identification data and a corresponding description of the related identification data to a user interface;

(D) determining if the related identification data is modified, if the related identification data is modified, then the related identification data is saved as a modified identification data; and (E) determining if a display driver is generated, if the display driver is generated, then the display driver is generated according to the modified identification data, the related identification data and the identification data;

wherein the display driver is used to drive the display correctly.

2. The method as claimed in claim 1 further comprising:

(F) determining if a description file is generated and, if the description file is generated, saving the modified identification data, the related identification data , the identification data and the corresponding description of the modified identification data, the related identification data and the identification data as a description file.

3. The method as claimed in claim 1, wherein data the modified identification data, the related identification data and the identification data are stored in a memory of the display.

4. The method as claimed in claim 1, wherein step (C) further comprises: displaying the related identification data in at least one predetermined color.

5. The method as claimed in claim 1, wherein the modified identification data, the related identification data and the identification data conform to a format of an extended display identification data standard.

* * * * *